United States Patent [19]

Brydolf

[11] 4,359,080

[45] Nov. 16, 1982

[54] HANGER FOR FOLDING PARTITION

[75] Inventor: Robert Brydolf, Pasadena, Calif.

[73] Assignee: Acme General Corporation, San Dimas, Calif.

[21] Appl. No.: 192,065

[22] Filed: Sep. 29, 1980

[51] Int. Cl.[3] ..... E05D 11/26

[52] U.S. Cl. ..... 160/199; 160/183; 160/206

[58] Field of Search ..... 160/84 R, 196 R, 196 D, 160/199, 206, 330, 345, 346, 183; 16/87 R, 87.2, 87.4 R, 95 R, 97, 87, 87.6, 104

[56] References Cited

U.S. PATENT DOCUMENTS

| | | | |
|---|---|---|---|
| 2,753,588 | 7/1956 | Grosh . | |
| 3,027,606 | 4/1962 | Nicklas | 16/104 |
| 3,098,520 | 7/1963 | Greenstadt et al. . | |
| 3,137,027 | 6/1964 | Birkle . | |
| 3,167,111 | 1/1965 | Harris . | |
| 3,193,870 | 7/1965 | McNinch | 16/97 |
| 3,277,952 | 10/1966 | Tsuhako . | |
| 3,422,878 | 1/1969 | Galietti | 160/199 |
| 3,516,473 | 6/1970 | Rosenquist | 160/199 |
| 3,908,731 | 9/1975 | Runka . | |
| 4,115,898 | 9/1978 | Frentzel . | |

*Primary Examiner*—Peter M. Caun

*Attorney, Agent, or Firm*—Christie, Parker & Hale

[57] ABSTRACT

A hanger is provided for suspending a slat of a multi-slat folding partition from an overhead track. The hanger has a shaft with a head at its upper end and a tang at its lower end. The tang is for engaging a hole through the top of the slat. A clip is on the shaft for holding the tang in the hole in the slat when the clip is in its lower position. A bogie is mounted on the shaft between the clip and the head of the shaft. The bogie engages an overhead track for suspending the slat for movement along the length of the track.

14 Claims, 4 Drawing Figures

HANGER FOR FOLDING PARTITION

FIELD OF THE INVENTION

This invention relates to a hanger for suspending a sheet member from an overhead track for movement along the length of the track.

BACKGROUND OF THE INVENTION

Various folding doors or partitions are provided in the art for closing off spaces such as closets or rooms or the like. The folding doors generally comprise a plurality of metal, wood, or plastic sheet members, i.e., slats, that are flexibly hinged together along their length.

For example, U.S. Pat. No. 3,908,731 to Runca discloses a metal panel, i.e., a slat and hinge assembly, for use in a folding door. U.S. Pat. No. 3,908,731 is incorporated herein by this reference. Although not shown, it is disclosed that this folding door assembly is mounted in an opening with "the usual suspension hardware".

Commonly, suspension hardware comprises a hanger which includes a wheel assembly connected to each panel. Additionally, the suspension hardware includes a track connected above an opening wherein the wheel assembly portion of the hanger rides in the track. Thus, the folding door is suspended from the track for movement along the length of the track. The slats can, therefore, fold against each other when the sliding door is in its OPEN position and can be extended from each other across the opening when the door is in its CLOSED position. One end of the folding door is generally fixed to one side of the opening with the other end free to be pulled across the opening to its opposite side. A latch is generally on the free end so that the door can be latched to the opposite side of the opening.

Generally, folding doors are provided that can be pulled from right to left across the opening, i.e., a right-hand door, or conversely can be pulled from left to right across the opening, i.e., a left-hand door.

Folding doors are generally assembled at the factory. The assembly procedure can, for example, comprise first securely connecting a hanger to the top of each slat provided. This can be accomplished by forming one or more holes through one end of the slat and crimping the slat and hanger together. Alternatively, the hanger can be screwed or bolted or otherwise connected to the end of the slat. The slats are then hinged together along their length. At one end of the hinged slat assembly, a latch section can be provided and, at the other end, a mounting section can be provided. The mounting section is provided so that the end of the folding door to which the mounting section is attached can be fixed to one side of the opening. The latch section comprises a latch for latching the folding door to the opposite side of the opening when the door is extended across the opening.

The above described method of assembly of a folding door at the factory can present several problems.

For example, when panels such as those disclosed in U.S. Pat. No. 3,908,731 to Runca are used, two different configurations of the panel and connected hanger must be provided so that the panels can be hinged together as shown. This increases the cost and complexity of the manufacturing operation.

Problems are also encountered after the panels of the folding door are hinged together for shipment.

Firstly, a hanger which is attached to each panel can be broken or otherwise damaged during shipment.

Since the hanger is crimped or otherwise securely attached to the panel, it cannot be easily removed and replaced in the field. The entire folding door can, therefore, be rejected by the customer and sent back to the factory for replacement of the hanger. This increases the cost of a folding door and additionally is unsatisfactory to the customer.

Secondly, folding doors can be provided with panels wherein one side of each panel is decorated as, for instance, by wood graining or the like. The wood grain side of the folding door is designed to face into a room after the door is installed. When the hangers and the latch and mounting sections are assembled at the factory, the wood grained folding door provided can be used only as a right-hand door or a left-hand door, depending on the placement of the hanger and the latch and mounting sections. Therefore, both right and left-handed doors must be supplied to the customer. This increases the cost of manufacturing and warehousing and the like and results in a more expensive product.

It is, therefore, desirable to provide a hanger for each panel of a foldable door that can be readily installed in the field, rather than at the factory. Preferably, the hanger can be installed on either end of each slat in the hinged assembly of slats so that only one door assembly need be provided for use either as a right-handed or left-handed door. The desired hanger is durable, easy to manufacture, and relatively simple to install in the field. Additionally, it is desirable to provide a hanger that, once installed, can be readily removed from the panel without damaging either the hanger or the panel.

SUMMARY OF THE INVENTION

This invention relates to a hanger for suspending a slat from an overhead track for movement along the length of the track. The hanger comprises a shaft having a head at its upper end. A tang extends laterally from a side of the shaft at a location on the shaft vertically spaced apart from its head for engaging a hole through the upper end of such a slat. Clip means is slidably mounted on the shaft for preventing disengagement of the tang from the hole through the slat. Means are also provided for suspending the shaft from an overhead track.

DRAWINGS

These and other features, aspects, and advantages of the present invention will be more fully understood when considered with respect to the following detailed description, appended claims, and accompanying drawings wherein:

DETAILED DESCRIPTION

Figure 1:
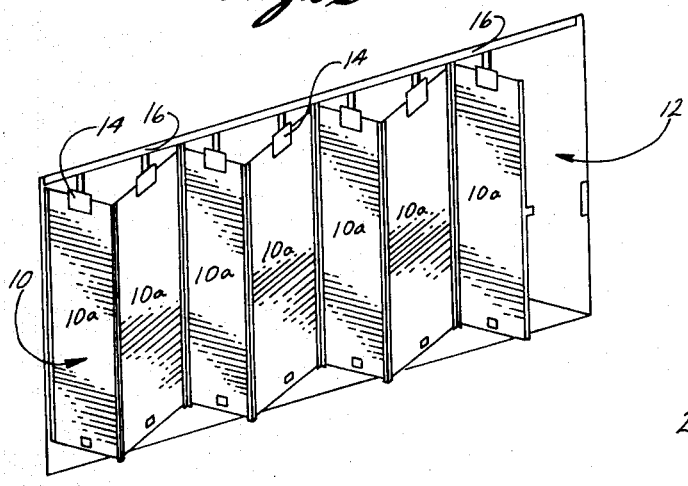
FIG. 1 is a schematic view of a multi-slat foldable partition with each slat suspended from a track by a hanger provided in accordance with this invention.

Referring to FIG. 1, there is shown a multi-slat foldable partition 10 installed in an opening 12. The foldable partition 10 comprises a plurality of elongated sheet members 10*a*, i.e., slats or panels, that are flexibly hinged together along their length.

A hanger 14 provided in accordance with this invention is attached to the top of each slat for suspending each slat from an overhead track 16. The hanger provides for movement of each slat along the length of the track.

The hanger 14 of this invention can be of various sizes and shapes, as desired, depending on the size and shape of the slats. For instance, slats can be flat or corrugated or have other shapes as desired. Additionally, the slats can vary in thickness and length and, hence, can be heavier or lighter, thereby requiring a hanger of more or less heavy duty construction.

Although the sheet member suspended by the hanger is, for purposes of exposition herein, shown as a slat or a panel, other sheet members can also be suspended. For example, the sheet member can be a curtain or a thin flexible plastic material or the like, either of which can be suspended from an overhead track by one or more hangers in accordance with this invention.

In a working embodiment, the hanger provided is for use in suspending a slat having a corrugated shape with the corrugations running along the length of the slat.

The details of the configuration of slats which are suspended by the working embodiment of the hanger provided in accordance with this invention can be found in U.S. Pat. No. 3,908,731 by Runca, which is incorporated hereinabove by reference.

The slats for use in accordance with this invention can be metal or plastic or can be of other suitable materials. Each slat provided has a hole through each of its ends.

The hanger, in accordance with this invention, can be attached to the slat through the hole at either end of the slat. When the slat has a configuration such as the configuration of the slat or panel disclosed by Runca and, additionally, has a hole through each end, only one configuration of said panel need be manufactured for use with a hanger provided in accordance with this invention. Additionally, the hanger of this invention can be easily installed in the field, i.e., such hangers can be installed readily at the work place after very little worker training.

Since hangers provided can be installed on the slats in the field rather than at the factory, the partition, i.e., the plurality of connected slats, can be suspended from either of its ends. Therefore, a right or left-handed door can be provided as desired. This is critical if the panels are decorated on one side so that the decorated side is to face into a room.

Figure 2:
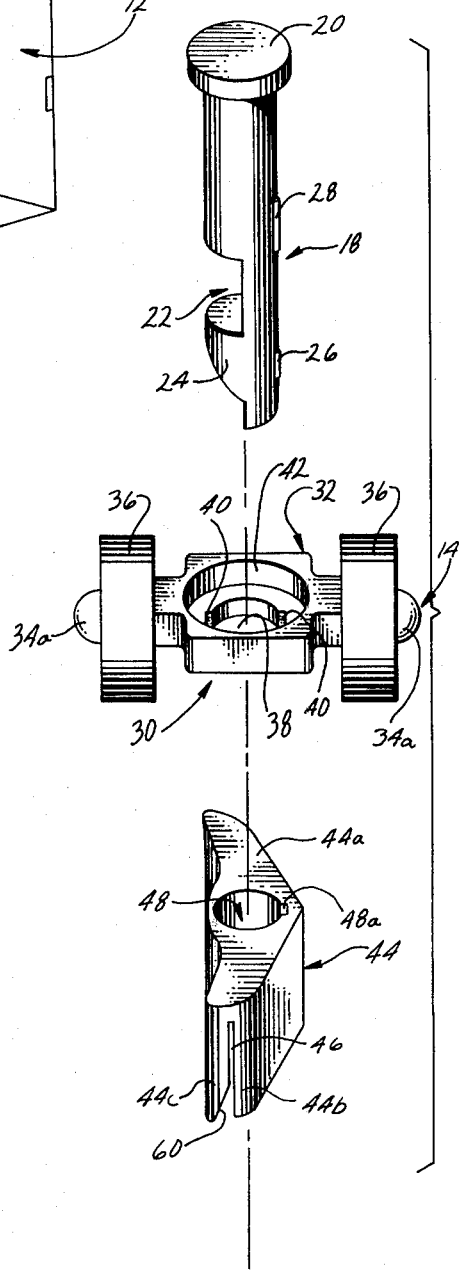
FIG. 2 is an exploded perspective view of a working embodiment of a hanger provided in accordance with this invention.
Figure 3:
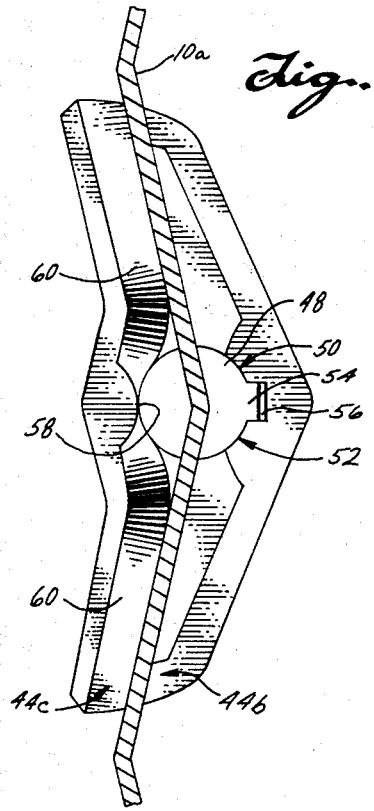
FIG. 3 is a schematic bottom view of the clip section of a hanger engaging a slat.
Figure 4:
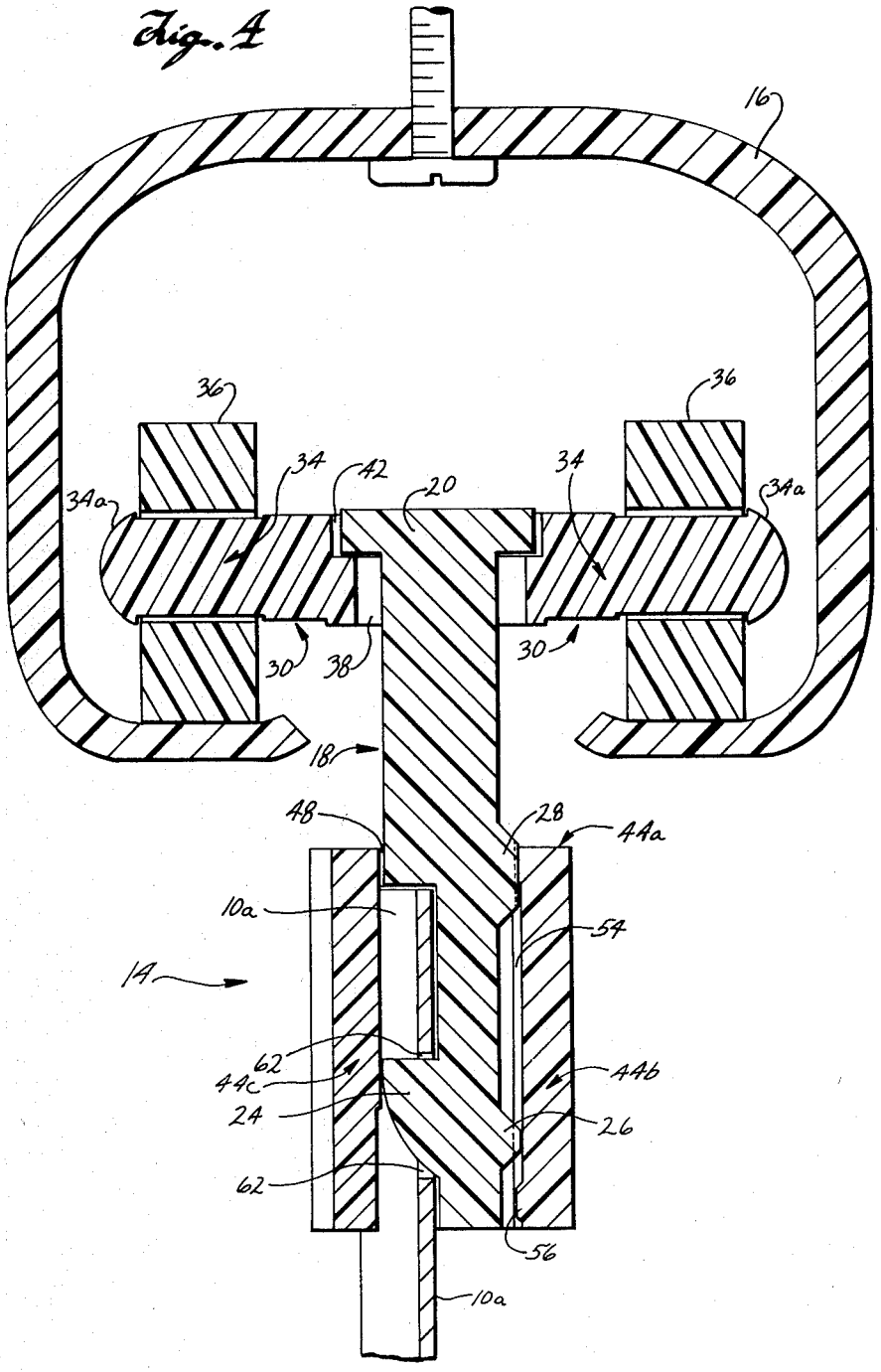
FIG. 4 is a schematic cross-sectional view of a hanger suspending a slat from an overhead track in accordance with this invention.

Details of the construction and assembly of the working embodiment of a hanger 14 provided in accordance with this invention can be understood by referring to FIGS. 2–4, in addition to FIG. 1. In all of the figures, like reference numerals refer to identical components of the hanger provided. Also, for purposes of exposition herein, the position of the components of the hanger and slat relative to each other are disclosed as if the hanger is attached to a slat which is suspended vertically from an overhead track.

The hanger of the working embodiment comprises a generally cylindrically shaped shaft 18 having a head 20 at its top. A notch 22 is in a lower portion of the shaft along its length. The notch in the working embodiment cuts away about half the cylinder starting about halfway down the shaft and extending to the end of the shaft.

A half arrow shaped tang 24 extends laterally from the side of the shaft, i.e., from the notch, and is nearer the lower end of the shaft than the head. Additionally, on the side of the shaft opposite the tang are two vertically spaced apart projections. A first projection 26 is near the lower end of the shaft and a second projection 28 is spaced apart vertically above the first projection.

In the working embodiment, the shaft is of one piece construction, molded from a suitable plastic material. If desired, however, the shaft can be made of other suitable materials such as metal or wood.

A bogie 30 which is slidably mounted on the shaft is also provided. The bogie 30 comprises a center section 32 having horizontal axles 34 extending from two of its opposite sides. A roller, such as a wheel 36, is on each axle. The wheels are held on the axle by an enlarged section of the axle 34*a* at its ends. The center section 32 of the bogie has a hole 38 formed vertically through its center. The orifice is circular with a generally rectangular notch 40 on each side extending beyond the diameter of the circle. The notches are on a line through the axles, but can be at other positions, if desired. Also, only one notch can be provided, if desired.

The diameter of the circular portion of the hole 38 is larger than the diameter of the shaft, but is not larger than the diameter of the shaft including either the upper or lower projection 26 or 28. Such a notch is, therefore, provided so that the shaft can be inserted through the hole 38 when the projections are aligned with either of the notches 40 in the body of the bogie.

The center section of the bogie also comprises a recess 42 which is circular and has a diameter large enough so that the head of the shaft can fit into said recess.

In the working embodiment, the bogie, including the body and wheels, is molded of plastic material. Other materials and other fabrication methods can be used, if desired.

A clip 44 is also provided and is slidably mounted on the shaft 18, i.e., the clip is slidably movable vertically along the shaft between the head 20 of the shaft and the tang 24. The clip 44 has a body section 44*a* and first and second wings 44*b* and 44*c* extending downwardly from the body section. Each wing has an inner face which is opposed to the inner face of the other wing. The opposed inner faces of the wings define a vertical slot 46 through the clip. A hole 48 is formed vertically through the top of the body section of the clip and communicates with the vertical slot defined by the faces of the wings.

The hole 48 is generally circular and has a diameter greater than the diameter of the shaft. Additionally, the hole has a rectangular slot 48*a* along its length extending vertically down the height of the body portion of the clip.

The diameter of the hole 48 is, however, not greater than the diameter of the shaft including either projection on the shaft and, therefore, the shaft can be inserted through the hole 48 only when the projections 26 and 28 are lined up with the slot 48*a*.

Referring now to FIG. 3, the configuration of the opposed inner faces of the wings can be understood. The inner face of the wing 44*b* has a first and a second horizontally spaced apart guide 50 and 52 extending vertically along its height. The guides define a slot 54 extending vertically along the inner face of the wing 44*b*. The slot 48*a* in the body of the clip is the same size as the slot 54 and communicates with the slot 54 on the face of the wing 44*b*. At about the bottom of the slot 54 is a detent 56 extending partway into the slot.

The opposed face of the wing 44*c* has a groove 58 along its length wherein the radius of the groove is about equal to the radius of the circular portion of the hole 48 and is contiguous with the hole 48. Additionally, the bottom portion of the opposed face of the wing 44*c* has a taper 60 along its bottom extending away from the wing 44*b*.

In the working embodiment, the clip is molded of a plastic material.

The hanger 14 is assembled and connected to the top of a slat by first lining up the projections 26 and 28 on the shaft 18 with one of the slots 40 of the hole through the bogie. The shaft is then inserted through the hole 38 so that the head 20 of the shaft is in the recess 42 in the bogie.

The projections on the shaft are then aligned with the slot 48*a* through the body of the clip and also with the contiguous slot 54 in the face of the wing 44*b*. The clip is then slid upwardly on the shaft. The projections 24 and 26 pass through the slot 48*a* and thence into the slot 54 in the face of the wing 44*b*. The slots 48*a* and 54 maintain the shaft in proper alignment with the clip.

The bogie is then turned on the shaft so that said bogie is transverse to the clip as shown in FIG. 2. The clip is then slid up the shaft as far as possible so that the top of the body 44*a* of the clip is against the bottom of the center section of the bogie. When the clip is in this position, i.e., its upper position, the clip clears the tang on the lower end of the shaft. In other words, the tang is now in a position below the bottom of the clip and a gap is between the tang 24 and the taper 60 on the wing 44*c*. The top edge of a slat is then inserted through the gap between the tang and the wing 40*c* and the tang is extended through a hole 62 through the top of the slat. The clip 44 is then pushed down along the shaft so that the wings 44*b* and 44*c* straddle the slat and the top edge of the slat is about against the bottom of the body portion of the clip. This is considered the lower or engaged position of the clip. In the engaged position, the detent 56 on the wing 44*b* is below the projection 26 on the lower end of the shaft, as can be seen in FIG. 4. The clip is inhibited from being slid upwardly along the shaft by the detent 56 engaging the projection 26. The clip is thereby substantially securely held in its lower or engaged position.

Additionally, the tang 24 is held securely in the hole 62 in the slat by the faces of the wings which encompass said tang. The clip, therefore, when in its lower or engaged position, prevents disengagement of the tang from the hole 62 in the slat.

Once a hanger is installed on each slat, the hanger is mounted on the track with the rollers in rolling engagement with the track.

One side of the partition can then be mounted to one side of the opening and the free end of the partition can be pulled across the opening and latched to its other side.

Although this invention is described in relation to only one working embodiment for use with a corrugated panel, such as that disclosed and provided by Runca, this working embodiment is for illustrative purposes. Because of variations which will be apparent to those skilled in the art, the present invention is not intended to be limited to the working embodiment described above. The scope of the invention is defined in the following claims.

What is claimed is:

1. A hanger for suspending a slat from an overhead track for movement along the length of the track comprising:

a shaft having a head at its upper end;

a tang extending laterally from a side of the shaft at a location on the shaft vertically spaced apart from its head for engaging a hole through the upper end of such a slat;

clip means mounted on the shaft capable of slidable movement along the length of the shaft after the tang has engaged such a hole through the upper end of the slat for preventing disengagement of the tang from the hole; and means for suspending the shaft from an overhead track.

2. A hanger as claimed in claim 1 wherein a bogie is rotatably mounted on the shaft adjacent the head of the shaft for suspending the shaft from an overhead track.

3. A hanger as claimed in claim 1 wherein the shaft has a notch along its length at its lower end and the tang extends laterally from the shaft in the notch.

4. A hanger as claimed in claim 1 wherein the tang is at about the end of the shaft opposite the head.

5. A hanger for suspending a sheet member from an overhead track for movement along the length of the track comprising:

a shaft having a head at its upper end;

a tang extending laterally from a side of the shaft nearer the lower end of the shaft than the head for engaging a hole through such a sheet member;

a clip slidably movable vertically along the shaft between the head and the tang after the tang has engaged a hole through such a sheet member comprising means for straddling the tang in a lower position and clearing the tang in an upper position; and roller means on the shaft for supporting the hanger from an overhead track.

6. A hanger as claimed in claim 5 wherein the clip comprises a body section and two spaced apart wings extending downwardly from said body section, the wings straddling the tang in a lower position and clearing the tang in an upper position.

7. A hanger for slidably suspending a slat of a multi-slat foldable partition from an overhead track comprising:

a shaft having a head at its upper end;

a tang extending laterally from a side of the shaft nearer its lower end than the head for engaging a hole through the upper end of such a slat;

a clip slidably mounted on the shaft comprising a body section and two spaced apart wings having opposed inner faces extending from said body section, the wings straddling the upper end of the slat and the tang when the tang is engaged in the hole and the clip is in a lower position for preventing disengagement of the tang from the hole; and a bogie mounted on the shaft between the head of the shaft and the clip for engaging an overhead track.

8. A hanger as claimed in claim 7 wherein a first projection extends from the surface of the shaft and a detent is on the inner face of one of the wings, the projection for engaging the detent when the clip is in a lower position for inhibiting the clip from being moved from such a lower position.

9. A hanger as claimed in claim 8 wherein two horizontally spaced apart guides form a slot along the height of the inner face of one of the wings, and a second projection extends from the surface of the shaft for engaging the slot for maintaining alignment between the shaft and the clip.

10. A hanger as claimed in claim 9 wherein the detent on the inner face of such a wing is in the slot.

11. In a folding partition comprising a plurality of vertically extending slats hingedly connected along their vertical length and slidably suspended from an overhead track, the combination of:

a slat;

a hole through such a slat at its upper end;

a hanger connected between the slat and the overhead track comprising:

a shaft having a head at its upper end;

a tang extending laterally from the shaft at its lower end for engaging the hole through the slat;

a clip mounted on the shaft capable of slidable movement along the length of the shaft after the tang has engaged such a hole through the upper end of the slat for preventing disengagement of the tang from the hole; and means for suspending the shaft from an overhead track.

12. A folding partition as claimed in claim 11 wherein the suspending means in a bogie mounted on the shaft, said bogie having a wheel at each end for engaging the overhead track.

13. A hanger for slidably suspending from an overhead track each slat of a multi-slat foldable partition comprising:

a shaft having a head at its upper end;

a notch in the shaft along its length;

a tang extending laterally from the shaft in the notch for engaging a hole through such a slat at its upper end;

a clip slidably mounted on the shaft comprising a body section and first and second spaced apart wings having opposed inner faces, the shaft aligned in the clip so that the tang extends toward a first opposed inner face, wherein said first opposed inner face has a taper on its end remote from the body portion of the clip, the wings straddling the upper end of the slat and the tang when the tang is engaged in the hole and the clip is in a lower position for preventing disengagement of the tang from the hole; and a bogie slidably mounted on the shaft between the head of the shaft and the clip, the bogie for engaging an overhead track.

14. A hanger as claimed in claim 7 wherein two horizontally spaced apart guides form a slot along the height of the inner face of one of the wings, and a projection extends from the surface of the shaft for engaging the slot for maintaining alignment between the shaft and the clip.

* * * * *